US010643789B2

(12) United States Patent
Kuniyoshi

(10) Patent No.: US 10,643,789 B2
(45) Date of Patent: May 5, 2020

(54) METHOD FOR PRODUCING R-T-B SINTERED MAGNET

(71) Applicant: HITACHI METALS, LTD., Minato-ku, Tokyo (JP)

(72) Inventor: Futoshi Kuniyoshi, Minato-ku (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/481,085

(22) PCT Filed: Jan. 31, 2018

(86) PCT No.: PCT/JP2018/003089
§ 371 (c)(1),
(2) Date: Jul. 26, 2019

(87) PCT Pub. No.: WO2018/143230
PCT Pub. Date: Aug. 9, 2018

(65) Prior Publication Data

US 2019/0371522 A1 Dec. 5, 2019

(30) Foreign Application Priority Data

Jan. 31, 2017 (JP) ..... 2017-015395

(51) Int. Cl.
*H01F 7/06* (2006.01)
*H01F 41/02* (2006.01)
(Continued)

(52) U.S. Cl.
CPC ..... *H01F 41/0293* (2013.01); *C22C 28/00* (2013.01); *H01F 1/0536* (2013.01); *H01F 1/0577* (2013.01); *C22C 2202/02* (2013.01)

(58) Field of Classification Search
CPC .. H01F 41/0293; H01F 1/0536; H01F 1/0577; H01F 7/02; B22F 3/24;
(Continued)

(56) References Cited

U.S. PATENT DOCUMENTS

2008/0286595 A1 11/2008 Yoshimura et al.
2014/0120248 A1 5/2014 Kuniyoshi
(Continued)

FOREIGN PATENT DOCUMENTS

EP 2 667 391 A1 11/2013
EP 3 503 130 A1 6/2019
(Continued)

OTHER PUBLICATIONS

Official Communication issued in International Patent Application No. PCT/JP2018/003089, dated May 15, 2018.

*Primary Examiner* — Paul D Kim
(74) *Attorney, Agent, or Firm* — Keating & Bennett, LLP

(57) ABSTRACT

A sintered R1-T-B based magnet work and an R2-Ga alloy are provided. The sintered magnet work contains R: 27.5 to 35.0 mass %, B: 0.80 to 0.99 mass %, Ga: 0 to 0.8 mass %, M: 0 to 2 mass % (where M is at least one of Cu, Al, Nb and Zr), and T: 60 mass % or more. A diffusion step of, while keeping at least a portion of the R2-Ga alloy in contact with at least a portion of a surface of the sintered magnet work, performing a first heat treatment at a temperature which is not lower than 700° C. and not higher than 950° C. to increase the RH amount contained in the sintered magnet work by not less than 0.05 mass % and not more than 0.40 mass %, is performed; and a second heat treatment is performed at a temperature which is not lower than 450° C. and not higher than 750° C. but which is lower than the temperature of the first heat treatment.

4 Claims, 2 Drawing Sheets

(51) Int. Cl.

| | |
|---|---|
| ***C22C 28/00*** | (2006.01) |
| ***H01F 1/053*** | (2006.01) |
| ***H01F 1/057*** | (2006.01) |

(58) Field of Classification Search
CPC ... B22F 3/26; B22F 9/02; C22C 28/00; C22C 30/00; C22C 38/00; C22C 38/16
See application file for complete search history.

(56) References Cited

U.S. PATENT DOCUMENTS

| | | | | |
|---|---|---|---|---|
| 2017/0263380 | A1 | 9/2017 | Mino | |
| 2018/0025819 | A1 | 1/2018 | Shigemoto et al. | |
| 2018/0047504 | A1 | 2/2018 | Nishiuchi et al. | |
| 2019/0172637 | A1* | 6/2019 | Lee | H01F 1/057 |
| 2019/0214191 | A1* | 7/2019 | Kuniyoshi | B22F 1/00 |
| 2019/0214192 | A1* | 7/2019 | Kuniyoshi | H01F 1/0536 |

FOREIGN PATENT DOCUMENTS

| | | | |
|---|---|---|---|
| WO | 2007/102391 | A1 | 9/2007 |
| WO | 2013/002170 | A1 | 1/2013 |
| WO | 2016/039352 | A1 | 3/2016 |
| WO | 2016/133071 | A1 | 8/2016 |
| WO | 2016/133080 | A1 | 8/2016 |

* cited by examiner

METHOD FOR PRODUCING R-T-B SINTERED MAGNET

TECHNICAL FIELD

The present invention relates to a method for producing a sintered R-T-B based magnet.

BACKGROUND ART

Sintered R-T-B based magnets (where R is at least one rare-earth element which always includes at least one of Nd and Pr; T is Fe, or Fe and Co; and B is boron) are known as permanent magnets with the highest performance, and are used in voice coil motors (VCM) of hard disk drives, various types of motors such as motors for electric vehicles (EV, HV, PHV, etc.) and motors for industrial equipment, home appliance products, and the like.

A sintered R-T-B based magnet is composed of a main phase which mainly consists of an $R_2T_{14}B$ compound and a grain boundary phase that is at the grain boundaries of the main phase. The $R_2T_{14}B$ compound, which is the main phase, is a ferromagnetic material having a high saturation magnetization and anisotropy field, and provides a basis for the properties of a sintered R-T-B based magnet.

There exists a problem in that coercivity $H_{cJ}$ (which hereinafter may be simply referred to as "coercivity" or as "$H_{cJ}$") of sintered R-T-B based magnets decreases at high temperatures, thus causing an irreversible thermal demagnetization. For this reason, sintered R-T-B based magnets for use in motors for electric vehicles, in particular, are required to have high $H_{cJ}$ at high temperatures, i.e., to have higher $H_{cJ}$ at room temperature.

CITATION LIST

Patent Literature

[Patent Document 1] International Publication No. 2007/102391

[Patent Document 2] International Publication No. 2016/133071

SUMMARY OF INVENTION

Technical Problem

It is known that $H_{cJ}$ is improved if Nd, as a light rare-earth element RL in an $R_2T_{14}B$-based compound phase, is replaced with a heavy rare-earth element (mainly Dy, Tb). However, in a sintered R-T-B based magnet, replacing the light rare-earth element (mainly Nd, Pr) with a heavy rare-earth element may improve $H_{cJ}$, but decrease its remanence $B_r$ (which hereinafter may be simply referred to as "remanence" or "$B_r$") because of decreasing the saturation magnetization of the $R_2T_{14}B$-based compound phase.

Patent Document 1 describes, while supplying a heavy rare-earth element such as Dy onto the surface of a sintered magnet of an R-T-B based alloy, allowing the heavy rare-earth element to diffuse into the interior of the sintered magnet. According to the method described in Patent Document 1, Dy is diffused from the surface of the sintered R-T-B based magnet into the interior, thus allowing Dy to thicken only in the outer crust of a main phase crystal grain that is effective for $H_{cJ}$ improvement, whereby high $H_{cJ}$ can be obtained with a suppressed decrease in $B_r$.

However, heavy rare-earth elements, in particular Dy and the like, are a scarce resource, and they yield only in limited regions. For this and other reasons, they have problems of instable supply, significantly fluctuating prices, and so on. Therefore, it has been desired in the recent years to improve $H_{cJ}$ while using as little heavy rare-earth element as possible.

Patent Document 2 describes allowing an R—Ga—Cu alloy of a specific composition to be in contact with the surface of an R-T-B based sintered compact whose B amount is lower than usual (i.e., lower than is defined by the stoichiometric ratio of the $R_2T_{14}B$ compound) and performing a heat treatment at a temperature which is not lower than 450° C. and not higher than 600° C., thus to control the composition and thickness of a grain boundary phase in the sintered R-T-B based magnet and improve $H_{cJ}$. According to the method described in Patent Document 2, $H_{cJ}$ can be improved without using a heavy rare-earth element such as Dy. In recent years, however, it is desired to obtain even higher $H_{cJ}$ while using as little heavy rare-earth element as possible, especially in motors for electric vehicles or the like.

Various embodiments of the present disclosure provide sintered R-T-B based magnets which have high $B_r$ and high $H_{cJ}$ while reducing the amount of any heavy rare-earth element used.

Solution to Problem

In an illustrative embodiment, a method for producing a sintered R-T-B based magnet according to the present disclosure comprises: a step of providing a sintered R1-T-B based magnet work that contains R1: not less than 27.5 mass % and not more than 35.0 mass % (where R1 is at least one rare-earth element which always includes at least one of Nd and Pr), B: not less than 0.80 mass % and not more than 0.99 mass %, Ga: not less than 0 mass % and not more than 0.8 mass %, M: not less than 0 mass % and not more than 2.0 mass % (where M is at least one of Cu, Al, Nb and Zr), and T: 60 mass % or more (where T is Fe, or Fe and Co, the Fe content accounting for 85 mass % or more in the entire T); a step of providing an R2-Ga alloy (where R2 is at least two light rare-earth elements which always include at least one of Tb and Dy and at least one of Pr and Nd; and 50 mass % or less of Ga can be replaced by at least one of Cu and Sn); a diffusion step of, while keeping at least a portion of at least a portion of the R2-Ga alloy in contact with at least a portion of a surface of the sintered R1-T-B based magnet work, performing a first heat treatment at a temperature which is not lower than 700° C. and not higher than 950° C. in a vacuum or an inert gas ambient, to increase a content of at least one of Tb and Dy in the sintered R1-T-B based magnet work by not less than 0.05 mass % and not more than 0.40 mass %; and a step of subjecting the sintered R1-T-B based magnet work having undergone the first heat treatment to a second heat treatment at a temperature which is not lower than 450° C. and not higher than 750° C. but which is lower than the temperature of the first heat treatment, in a vacuum or an inert gas ambient.

In one embodiment, the sintered R1-T-B based magnet work satisfies eq. (1) below:

$$[T]/55.85>14\times[B]/10.8 \quad (1)$$

(where [T] is the T content by mass %; and [B] is the B content by mass %).

In one embodiment, the R2-Ga alloy always contains Pr, and the Pr content accounts for 50 mass % or more of the entire R2.

In one embodiment, the R2 in the R2-Ga alloy comprises Pr and at least one of Tb and Dy.

In one embodiment, in the R2-Ga alloy, R2 accounts for not less than 65 mass % and not more than 97 mass % of the entire R2-Ga alloy, and Ga accounts for not less than 3 mass % and not more than 35 mass % of the entire R2-Ga alloy.

Advantageous Effects of Invention

According to an embodiment of the present disclosure, a heat treatment is performed at a specific temperature (not lower than 700° C. and not higher than 950° C.) while a sintered R1-T-B based magnet work is in contact with an R2-Ga alloy, thus allowing at least one of Tb and Dy (which may hereinafter be simply referred to as "RH"), at least one of Pr and Nd (which may hereinafter be simply referred to as "RL"), and Ga to be diffused into the magnet work interior via grain boundaries. In the meantime, an RH amount in a very minute range (not less than 0.05 mass % and not more than 0.40 mass %) is diffused together with RL and Ga into the magnet work interior, whereby a very high effect of $H_{cJ}$ improvement can be obtained. This provides a sintered R-T-B based magnet having high $B_r$ and high $H_{cJ}$, while reducing the amount of any heavy rare-earth element used.

DESCRIPTION OF EMBODIMENTS

Figure 1:
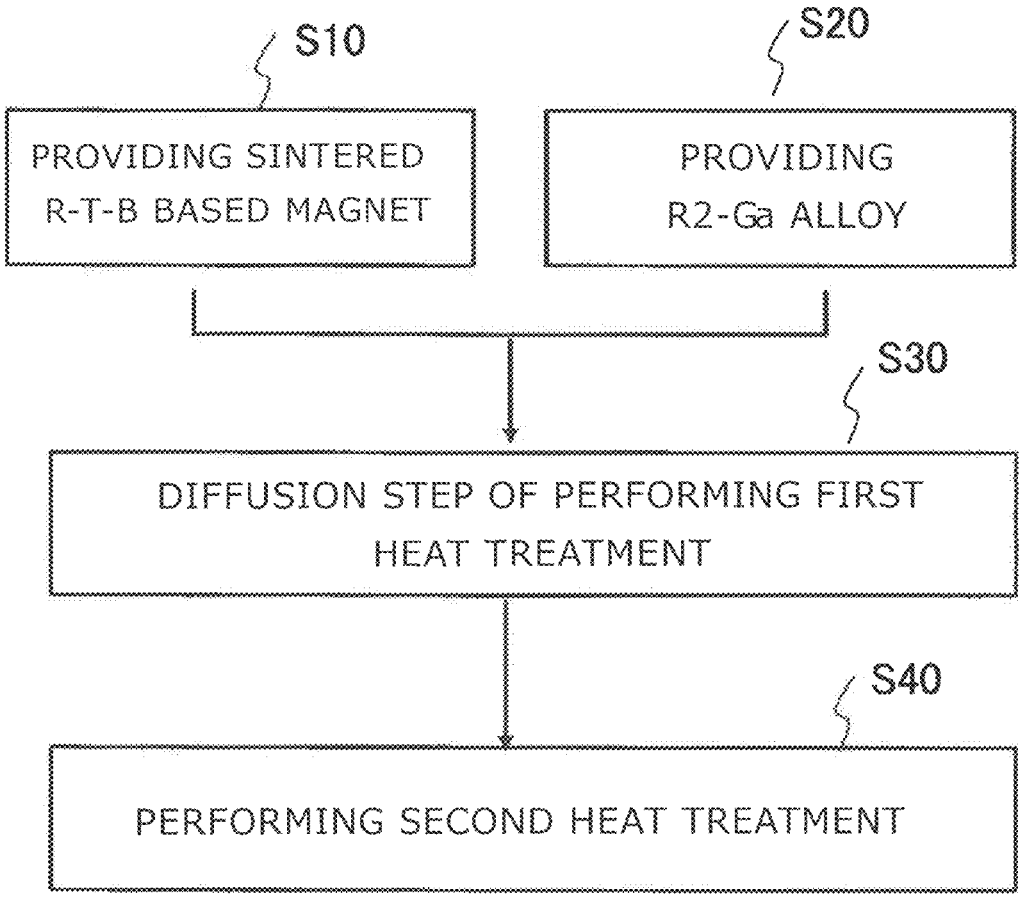
FIG. 1 A flowchart showing example steps in a method for producing a sintered R-T-B based magnet according to the present disclosure.

As shown in FIG. 1, a method for producing a sintered R-T-B based magnet according to the present disclosure includes step S10 of providing a sintered R1-T-B based magnet work and step S20 of providing an R2-Ga alloy. The order of step S10 of providing a sintered R1-T-B based magnet work and step S20 of providing an R2-Ga alloy may be arbitrary; and a sintered R1-T-B based magnet work and an R2-Ga alloy which have been produced in different places may be used.

The sintered R1-T-B based magnet work contains:

R1: 27.5 to 35.0 mass % (where R1 is at least one rare-earth element which always includes at least one of Nd and Pr), B: 0.80 to 0.99 mass %, Ga: 0 to 0.8 mass %, M: 0 to 2 mass % (where M is at least one of Cu, Al, Nb and Zr), T: 60 mass % or more (where T is Fe, or Fe and Co, the Fe content accounting for 85 mass % in the entire T).

Preferably, this sintered R1-T-B based magnet work satisfies eq. (1) below, where the T content (mass %) is denoted as [T] and the B content (mass %) is denoted as [B].

$$[T]/55.85>14\times[B]/10.8 \quad (1)$$

This eq. (1) being satisfied means that the B content is smaller than is defined by the stoichiometric ratio of the $R_2T_{14}B$ compound, i.e., there is a relatively small B amount for the T amount that is consumed in the main phase ($R_2T_{14}B$ compound) formation.

In the R2-Ga alloy, R2 is at least two rare-earth elements which always include at least one of Tb and Dy and at least one of Pr and Nd. For example, the R2-Ga alloy may be an alloy of 65 to 97 mass % R2 and 3 mass % to 35 mass % Ga. However, 50 mass % or less of Ga may be replaced by at least one of Cu and Sn. The R2-Ga alloy may contain inevitable impurities.

As shown in FIG. 1, the method for producing a sintered R-T-B based magnet according to the present disclosure further includes: a diffusion step S30 of, while keeping at least a portion of the R2-Ga alloy in contact with at least a portion of the surface of the sintered R1-T-B based magnet work, performing a first heat treatment at a temperature which is not lower than 700° C. and not higher than 950° C. in a vacuum or an inert gas ambient, to increase the content of at least one of Tb and Dy in the sintered R1-T-B based magnet work by not less than 0.05 mass % and not more than 0.40 mass %; and step S40 of subjecting the sintered R1-T-B based magnet work having undergone this first heat treatment to a second heat treatment at a temperature which is not lower than 450° C. and not higher than 750° C. but which is lower than the temperature of the first heat treatment, in a vacuum or an inert gas ambient. The diffusion step S30 of performing the first heat treatment is performed before the step S40 of performing the second heat treatment. Between the diffusion step S30 of performing the first heat treatment and step S40 of performing the second heat treatment, any other step may be performed, e.g., a cooling step; a step of retrieving the sintered R1-T-B based magnet work out of a mixture of the R2-Ga alloy and the sintered R1-T-B based magnet work; or the like.

1. Mechanism

<Structure of Sintered R-T-B Based Magnet>

First, the fundamental structure of a sintered R-T-B based magnet according to the present disclosure will be described. The sintered R-T-B based magnet has a structure such that powder particles of a raw material alloy have bound together through sintering, and is composed of a main phase which mainly consists of an $R_2T_{14}B$ compound and a grain boundary phase which is at the grain boundaries of the main phase.

Figure 2A:
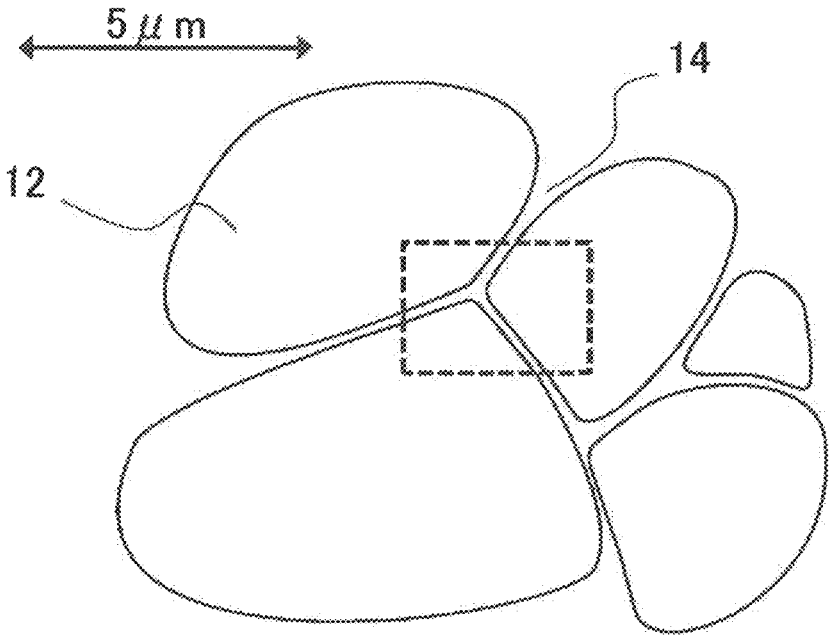
FIG. 2A A partially enlarged cross-sectional view schematically showing a sintered R-T-B based magnet.
Figure 2B:
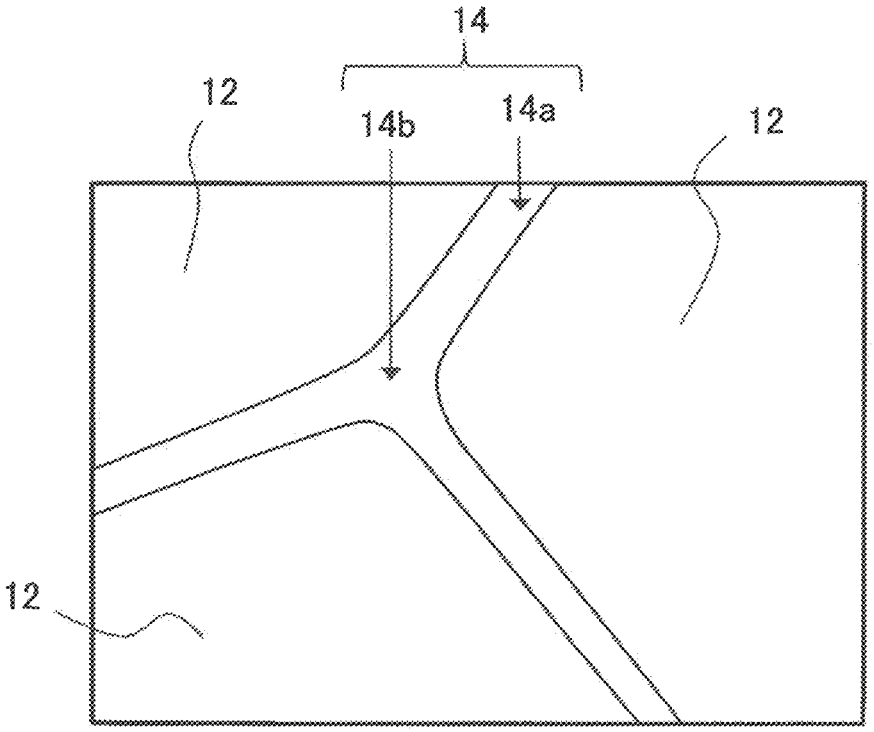
FIG. 2B A further enlarged cross-sectional view schematically showing the interior of a broken-lined rectangular region in FIG. 2A.

FIG. 2A is a partially enlarged cross-sectional view schematically showing a sintered R-T-B based magnet. FIG. 2B is a further enlarged cross-sectional view schematically showing the interior of a broken-lined rectangular region in FIG. 2A. In FIG. 2A, arrowheads indicating a length of 5 μm are shown as an example of reference length to represent size. As shown in FIG. 2A and FIG. 2B, the sintered R-T-B based magnet is composed of a main phase which mainly consists of an $R_2T_{14}B$ compound 12 and a grain boundary phase 14 which is at the grain boundaries of the main phase 12. Moreover, as shown in FIG. 2B, the grain boundary phase 14 includes an intergranular grain boundary phase 14*a* in which two $R_2T_{14}B$ compound grains adjoin each other, and grain boundary triple junctions 14*b* at which three $R_2T_{14}B$ compound grains adjoin one another. A typical main phase crystal grain size is not less than 3 μm and not more than 10 μm, this being an average value of the diameter of an approximating circle in the magnet cross section. The main phase 12, i.e., the $R_2T_{14}B$ compound, is a ferromagnetic material having high saturation magnetization and an anisotropy field. Therefore, in a sintered R-T-B based magnet, it is possible to improve $B_r$ by increasing the abundance ratio of the $R_2T_{14}B$ compound which is the main phase 12. In order to increase the abundance ratio of the $R_2T_{14}B$ compound, the R amount, the T amount, and the B amount in the raw material alloy may be brought closer to the stoichiometric ratio of the $R_2T_{14}B$ compound (i.e., the R amount:the T amount:the B amount=2:14:1).

In the present disclosure, RL and Ga are diffused, together with an infinitesimal amount of RH, from the surface of the sintered R1-T-B based magnet work into the magnet work interior, via grain boundaries. It has been found through a study by the inventors that, when RH, RL, and Ga are allowed to diffuse together at a specific temperature, owing to the action of a liquid phase containing RL and Ga, diffusion of RH into the magnet interior can be greatly promoted. As a result of this, RH can be introduced into the magnet work interior by a small RH amount, while also attaining a high effect of $H_{cJ}$ improvement. It has further been found through studies that this high effect of $H_{cJ}$ improvement is obtained when RH is introduced in a very minute range. In other words, the present disclosure comprises a finding that, when an RH amount in a very minute range (not less than 0.05 mass % and not more than 0.40 mass %) is diffused together with RL and Ga into the magnet work interior, a very high effect of $H_{cJ}$ improvement is obtained, while reducing the amount of RH used.

2. Terminology (Sintered R1-T-B Based Magnet Work and Sintered R-T-B Based Magnet)

In the present disclosure, any sintered R-T-B based magnet prior to a first heat treatment or during a first heat treatment will be referred to as a "sintered R1-T-B based magnet work"; any sintered R-T-B based magnet after a first heat treatment but prior to or during a second heat treatment will be referred to as a "sintered R1-T-B based magnet work having undergone the first heat treatment"; and any sintered R-T-B based magnet after the second heat treatment will be simply referred to as a "sintered R-T-B based magnet".

(R-T-Ga Phase)

An R-T-Ga phase is a compound containing R, T and Ga, a typical example thereof being an $R_6T_{13}Ga$ compound. An $R_6T_{13}Ga$ compound has a $La_6Co_{11}Ga_3$ type crystal structure. An $R_6T_{13}Ga$ compound may take the form of an $R_6T_{13}$-$\delta Ga_{1+}\delta$ compound. In the case where Cu, Al and Si are contained in the sintered R-T-B based magnet, the R-T-Ga phase may be $R_6T_{13}$-$\delta(Ga_{1-x-y-z}Cu_xAl_ySi_z)_{1+}\delta$.

3. Reasons for the Limited Composition and so on (Sintered R1-T-B Based Magnet Work)

(R1)

The R1 content is not less than 27.5 mass % and not more than 35.0 mass %. R1 is at least one rare-earth element which always includes at least one of Nd and Pr. If R1 accounts for less than 27.5 mass %, a liquid phase will not sufficiently occur in the sintering process, and it will be difficult for the sintered compact to become adequately dense in texture. On the other hand, if R exceeds 35.0 mass %, grain growth will occur during sintering, thus lowering $H_{cJ}$. R1 preferably accounts for not less than 28 mass % and not more than 33 mass %, and more preferably not less than 29 mass % and not more than 33 mass %.

(B)

The B content is not less than 0.80 mass % and not more than 0.99 mass %. If the B content is less than 0.80 mass %, $B_r$ may lower; if it exceeds 0.99 mass %, $H_{cJ}$ may lower. B may be partially replaced with C.

(Ga)

The Ga content in the sintered R1-T-B based magnet work before Ga is diffused from the R2-Ga alloy is not less than 0 mass % and not more than 0.8 mass %. In the present disclosure, Ga is introduced by allowing an R2-Ga alloy to diffuse into the sintered R1-T-B based magnet work; therefore, the sintered R1-T-B based magnet work may not contain any Ga (i.e., 0 mass %). If the Ga content exceeds 0.8 mass %, magnetization of the main phase may become lowered due to Ga being contained in the main phase as described above, so that high $B_r$ may not be obtained. Preferably, the Ga content is 0.5 mass % or less, as this will provide higher $B_r$.

(M)

The M content is not less than 0 mass % and not more than 2.0 mass %. M is at least one of Cu, Al, Nb and Zr; although it may be 0 mass % and still the effects of the present disclosure will be obtained, a total of 2.0 mass % or less of Cu, Al, Nb and Zr may be contained. Cu and/or Al being contained can improve $H_{cJ}$. Cu and/or Al may be purposely added, or those which will be inevitably introduced during the production process of the raw material or alloy powder used may be utilized (a raw material containing Cu and/or Al as impurities may be used). Moreover, Nb and/or Zr being contained will suppress abnormal grain growth of crystal grains during sintering. Preferably, M always contains Cu, such that Cu is contained in an amount of not less than 0.05 mass % and not more than 0.30 mass %. The reason is that Cu being contained in an amount of not less than 0.05 mass % and not more than 0.30 mass % will allow $H_{cJ}$ to be further improved.

(T)

The T content is 60 mass % or more. If the T content is less than 60 mass %, $B_r$ and $H_{cJ}$ may greatly lower. T is Fe, or Fe and Co, the Fe content accounting for 85 mass % or more in the entire T. If the Fe content is less than 85 mass %, $B_r$ and $H_{cJ}$ may lower. As used herein, "the Fe content accounting for 85 mass % or more in the entire T" means that, in the case where e.g. the T content accounts for 75 mass % in the sintered R1-T-B based magnet work, 63.7 mass % or more of the sintered R1-T-B based magnet work is Fe. Preferably, the Fe content accounts for 90 mass % or more in the entire T, as this will provide higher $B_r$ and higher $H_{cJ}$. Moreover, Fe may be partially replaced with Co. However, if the amount of substituted Co exceeds 10% of the entire T by mass ratio, $B_r$ will lower, which is not preferable. Furthermore, in addition to the aforementioned elements, a sintered R1-T-B based magnet work according to the present disclosure may contain Ag, Zn, In, Sn, Ti, Ni, Hf, Ta, W, Ge, Mo, V, Y, La, Ce, Sm, Ca, Mg, Cr, H, F, P, S, Cl, O, N, C, and the like. The preferable contents are: Ni, Ag, Zn, In, Sn and Ti each account for 0.5 mass % or less; Hf, Ta, W, Ge, Mo, V, Y, La, Ce, Sm, Ca, Mg and Cr each account for 0.2 mass % or less; H, F, P, S and Cl account for 500 ppm or less; O accounts for 6000 ppm or less; N accounts for 1000 ppm or less; and C accounts for 1500 ppm or less. A total content of these elements preferably accounts for 5 mass % or less of the entire sintered R1-T-B based magnet work. If a total content of these elements exceeds 5 mass % of the entire R1-T-B based sintered work, high $B_r$ and high $H_{cJ}$ may not be obtained.

(eq. (1))

$$[T]/55.85>14\times[B]/10.8 \quad (1)$$

Herein, [T] denotes the T content (mass %), and [B] denotes the B content (mass %).

As the composition of the sintered R1-T-B based magnet work satisfies eq. (1) and further contains Ga, an R-T-Ga phase will be generated at the grain boundaries of the sintered R-T-B based magnet as finally obtained, whereby high $H_{cJ}$ can be obtained. When Inequality (1) is satisfied, the B content is smaller than in commonly-available sintered R-T-B based magnets. Commonly-available sintered R-T-B based magnets have compositions in which [T]/55.85 (i.e., the atomic weight of Fe) is smaller than 14×[B]/10.8 (i.e., the atomic weight of B), in order to ensure that an Fe phase or an $R_2T_{17}$ phase will not occur in addition to the main phase, i.e., an $R_2T_{14}B$ phase (where [T] is the T content by mass %; and [B] is the B content by mass %). Unlike in commonly-available sintered R-T-B based magnets, the sintered R1-T-B based magnet work according to a preferred embodiment of the present disclosure is defined by Inequality (1) so that [T]/55.85 (i.e., the atomic weight of Fe) is greater than 14×[B]/10.8 (i.e., the atomic weight of B). The reason for reciting the atomic weight of Fe is that the main component of T in the sintered R1-T-B based magnet work according to the present disclosure is Fe.

(R2-Ga Alloy)

In the R2-Ga alloy, R2 is at least two rare-earth elements which always include at least one of Tb and Dy and at least one of Pr and Nd. Preferably, R2 accounts for 65 to 97 mass % of the entire R2-Ga alloy, and Ga accounts for 3 mass % to 35 mass % of the entire R2-Ga alloy. Contents of the at least one of Tb and Dy in R2 preferably account for not less than 3 mass % and not more than 24 mass %, in total, of the entire R2-Ga alloy. Contents of the at least one of Pr and Nd in R2 preferably account for not less than 65 mass % and not more than 86 mass %, in total, of the entire R2-Ga alloy. Moreover, 50 mass % or less of Ga may be replaced by at least one of Cu and Sn. Inevitable impurities may be contained. In the present disclosure, that "50 mass % or less of Ga may be replaced by Cu" means that, given a Ga content (mass %) in the R2-Ga alloy being defined as 100%, 50% thereof may be replaced by Cu. For example, if Ga accounts for 20 mass % in the R2-Ga alloy, then Cu may be substituted up to 10 mass %. The same is also true of Sn. Preferably, the R2-Ga alloy always contains Pr, and the Pr content accounts for 50 mass % or more of the entire R2; more preferably, R2 is composed of Pr and at least one of Tb and Dy. When Pr is contained, diffusion into the grain boundary phase is promoted, thus allowing RH to be more efficiently diffused and making it possible to obtain higher $H_{cJ}$.

The shape and size of the R2-Ga alloy are not particularly limited, and may be arbitrary. The R2-Ga alloy may take the shape of a film, a foil, powder, a block, particles, or the like.

4. Providing Steps (Step of Providing Sintered R1-T-B Based Magnet Work)

A sintered R1-T-B based magnet work can be provided by using a generic method for producing a sintered R-T-B based magnet, e.g., an Nd—Fe—B based sintered magnet. As one example, a raw material alloy which is produced by a strip casting method or the like may be pulverized to not less than 3 μm and not more than 10 μm by using a jet mill or the like, thereafter pressed in a magnetic field, and then sintered at a temperature of not lower than 900° C. and not higher than 1100° C.

If the pulverized particle size (a central value of volume as obtained through measurement by an airflow-dispersion laser diffraction method=$D_{50}$) of the raw material alloy is less than 3 μm, it becomes very difficult to produce pulverized powder, thus resulting in a greatly reduced production efficiency, which is not preferable. On the other hand, if the pulverized particle size exceeds 10 μm, the sintered R-T-B based magnet as finally obtained will have too large a crystal grain size to achieve high $H_{cJ}$, which is not preferable. So long as the aforementioned conditions are satisfied, the sintered R1-T-B based magnet work may be produced from one kind of raw material alloy (a single raw-material alloy), or through a method of using two or more kinds of raw material alloys and mixing them (blend method).

(Step of Providing R2-Ga Alloy)

The R2-Ga alloy can be provided by a method of producing a raw material alloy that is adopted in generic methods for producing a sintered R-T-B based magnet, e.g., a mold casting method, a strip casting method, a single roll rapid quenching method (a melt spinning method), an atomizing method, or the like. Moreover, the R2-Ga alloy may be what is obtained by pulverizing an alloy obtained as above with a known pulverization means such as a pin mill.

5. Heat Treatment Steps (Diffusion Step)

A diffusion step is performed which involves, while keeping at least a portion of the R2-Ga alloy in contact with at least a portion of the surface of the sintered R1-T-B based magnet work that has been provided as above, performing a first heat treatment at a temperature which is not lower than 700° C. and not higher than 950° C. in a vacuum or an inert gas ambient, in order to increase the content of at least one of Tb and Dy in the sintered R1-T-B based magnet work by not less than 0.05 mass % and not more than 0.40 mass %. As a result of this, a liquid phase containing RH, RL and Ga emerges from the R2-Ga alloy, and this liquid phase is introduced from the surface to the interior of the sintered work through diffusion, via grain boundaries in the sintered R1-T-B based magnet work. At this time, by increasing the RH content in the sintered R1-T-B based magnet work in an infinitesimal range of not less than 0.05 mass % and not more than 0.40 mass %, a very high effect of $H_{cJ}$ improvement can be obtained. If the increase in the RH content in the sintered R1-T-B based magnet work is less than 0.05 mass %, the amount of RH introduced in the magnet work interior will be too little to obtain high $H_{cJ}$. On the other hand, if the increase in the RH content in the sintered R1-T-B based magnet work exceeds 0.40 mass %, the effect of $H_{cJ}$ improvement will be low, thus hindering a sintered R-T-B based magnet having high $B_r$ and high $H_{cJ}$ from being obtained while reducing the amount of RH used. In order to increase the content of at least one of Tb and Dy in the sintered R1-T-B based magnet work by not less than 0.05 mass % and not more than 0.40 mass %, various conditions may be adjusted, such as: the amount of R2-Ga alloy; the heating temperature during the process; the particle size (in the case where the R2-Ga alloy is in particle form); and the processing time. Among these, the introduced amount of RH (amount of increase) can be relatively easily controlled by adjusting the amount of R2-Ga alloy and the heating temperature during the process. It must be noted for clarity's sake that, in the present specification, to "increase the content of at least one of Tb and Dy by not less than 0.05 mass % and not more than 0.40 mass %" means that, regarding the content as expressed in mass %, its value is increased by not less than 0.05 and not more than 0.40. For example, if the Tb content of the sintered R1-T-B based magnet work before the diffusion step is 0.50 mass % and the Tb content in the sintered R1-T-B based magnet work after the diffusion step is 0.60 mass %, it is to be understood that the diffusion step has increased the Tb content by 0.10 mass %.

The determination as to whether the content of at least one of Tb and Dy (RH amount) has increased by not less than 0.05 mass % and not more than 0.40 mass % is made by measuring the Tb and Dy contents in the entirety of the sintered R-T-B based magnet work before the diffusion step and the sintered R1-T-B based magnet work after the diffusion step (or the sintered R-T-B based magnet after the second heat treatment), and seeing how much the Tb and Dy contents (a total content of Tb and Dy) have increased through the diffusion. If any thickened portion of R2-Ga alloy exists on the surface of the sintered R1-T-B based magnet work after the diffusion (or on the surface of the sintered R-T-B based magnet after the second heat treatment), the thickened portion is removed by cutting, etc., before measuring the RH amount.

If the first heat treatment temperature is lower than 700° C., the amount of liquid phase containing RH, RL and Ga will be too little to obtain high $H_{cJ}$. On the other hand, if it exceeds 950° C., $H_{cJ}$ may lower. Preferably, it is not lower than 900° C. and not higher than 950° C., as this will provide higher $H_{cJ}$. Preferably, the sintered R1-T-B based magnet work having undergone the first heat treatment (not lower than 700° C. and not higher than 950° C.) is cooled to 300° C. at a cooling rate of 5° C./minute or more, from the temperature at which the first heat treatment was performed, as this will provide higher $H_{cJ}$. Even more preferably, the cooling rate down to 300° C. is 15° C./minute or more.

The first heat treatment can be performed by placing an R2-Ga alloy in any arbitrary shape on the surface of the sintered R1-T-B based magnet work, and using a known heat treatment apparatus. For example, the surface of the sintered R1-T-B based magnet work may be covered by a powder layer of the R2-Ga alloy, and the first heat treatment may be performed. For example, after a slurry obtained by dispersing the R2-Ga alloy in a dispersion medium is applied on the surface of the sintered R1-T-B based magnet work, the dispersion medium may be evaporated, thus allowing the R2-Ga alloy to come in contact with the sintered R1-T-B based magnet work. Examples of the dispersion medium may be alcohols (ethanol, etc.), NMP (N-methylpyrrolidone), aldehydes, and ketones. Not only from the R2-Ga alloy, but RH may also be introduced by placing, a fluoride, an oxide, an oxyfluoride, etc., of RH on the surface of the sintered R1-T-B based magnet, together with the R2-Ga alloy. In other words, so long as RL and Ga can be simultaneously diffused together with RH, there is no particular limitation as to the method thereof. Examples of fluorides, oxides, and oxyfluorides of RH may include $TbF_3$, $DyF_3$, $Tb_2O_3$, $Dy_2O_3$, $Tb_4OF$, and $Dy_4OF$.

The R2-Ga alloy may be placed at any arbitrary position so long as at least a portion of the R2-Ga alloy is in contact with at least a portion of the sintered R1-T-B based magnet work; however, as will be indicated by Experimental Examples below, it is preferable that the R2-Ga alloy is placed so as to be in contact with at least a surface that is perpendicular to the alignment direction of the sintered R1-T-B based magnet work. This will allow a liquid phase containing R2 and Ga to be introduced from the magnet surface into the interior more efficiently through diffusion. In this case, the R2-Ga alloy may be in contact in the alignment direction of the sintered R1-T-B based magnet work alone, or the R2-Ga alloy may be in contact with the entire surface of the sintered R1-T-B based magnet work.

(Step of Performing Second Heat Treatment)

The sintered R1-T-B based magnet work having undergone the first heat treatment is subjected to a heat treatment at a temperature which is not lower than 450° C. and not higher than 750° C. but which is lower than the temperature effected in the step of performing the first heat treatment, in a vacuum or an inert gas ambient. In the present disclosure, this heat treatment is referred to as the second heat treatment. By performing the second heat treatment, an R-T-Ga phase is generated, whereby high $H_{cJ}$ can be obtained. If the second heat treatment is at a higher temperature than is the first heat treatment, or if the temperature of the second heat treatment is below 450° C. or above 750° C., the generated amount of R-T-Ga phase will be too little to obtain high $H_{cJ}$.

EXAMPLES

Example 1

[Providing Sintered R1-T-B Based Magnet Work]

Raw materials of respective elements were weighed so that the alloy composition would approximately result in the composition shown indicated as No. A-1 in Table 1, and an alloy was produced by a strip casting technique. The resultant alloy was coarse-pulverized by a hydrogen pulverizing method, thus obtaining a coarse-pulverized powder. Next, to the resultant coarse-pulverized powder, zinc stearate was added as a lubricant in an amount of 0.04 mass % relative to 100 mass % of coarse-pulverized powder; after mixing, an airflow crusher (jet mill machine) was used to effect dry milling in a nitrogen jet, whereby a fine-pulverized powder (alloy powder) with a particle size $D_{50}$ of 4 μm was obtained. To the fine-pulverized powder, zinc stearate was added as a lubricant in an amount of 0.05 mass % relative to 100 mass % of fine-pulverized powder; after mixing, the fine-pulverized powder was pressed in a magnetic field, whereby a compact was obtained. As a pressing apparatus, a so-called orthogonal magnetic field pressing apparatus (transverse magnetic field pressing apparatus) was used, in which the direction of magnetic field application ran orthogonal to the pressurizing direction. In a vacuum, the resultant compact was sintered for 4 hours at 1080° C. (i.e., a temperature was selected at which a sufficiently dense texture would result through sintering), whereby a plurality of sintered R1-T-B based magnet works were obtained. Each resultant sintered R1-T-B based magnet work had a density of 7.5 $Mg/m^3$ or more. A component analysis of the resultant sintered R1-T-B based magnet works is shown in Table 1. The respective components in Table 1 were measured by using Inductively Coupled Plasma Optical Emission Spectroscopy (ICP-OES). Any instance of eq. (1) according to the present disclosure being satisfied is indicated as "○"; any instance of failing to satisfy it is indicated as "X". For reference sake, one of the resultant sintered R1-T-B based magnet works was subjected to usual tempering (500° C.), and its $B_r$ and $H_{cJ}$ were measured with a B—H tracer, which indicated $B_r$: 1.39 T, $H_{cJ}$: 1385 kA/m.

TABLE 1

| | composition of sintered R1-T-B based magnet work (mass %) | | | | | | | | | | | | |
|---|---|---|---|---|---|---|---|---|---|---|---|---|---|
| No. | Nd | Pr | Dy | Tb | B | Cu | Al | Ga | Zr | Nb | Co | Fe | eq. (1) |
| A-1 | 24.0 | 6.0 | 0.0 | 0.0 | 0.89 | 0.1 | 0.1 | 0.3 | 0.0 | 0.0 | 1.0 | 68.6 | ○ |

[Providing R2-Ga Alloy]

Raw materials of respective elements were weighed so that the alloy composition would approximately result in the compositions indicated as Nos. B-1 to B-6 in Table 2, and these raw materials were melted; thus, by a single roll rapid quenching method (melt spinning method), an alloy in ribbon or flake form was obtained. Using a mortar, the resultant alloy was pulverized in an argon ambient, and thereafter was passed through a sieve with an opening of 425 μm, thereby providing an R2-Ga alloy. The components of the resultant R2-Ga alloy were measured by using Inductively Coupled Plasma Optical Emission Spectroscopy (ICP-OES). The component analysis is shown in Table 2.

For use as comparative example, $TbF_3$ having a particle size $D_{50}$ of 100 μm or less was provided.

TABLE 2

| | composition of R2-Ga alloy(mass %) | | |
|---|---|---|---|
| No. | Tb | Pr | Ga |
| B-1 | 3 | 86 | 11 |
| B-2 | 6 | 83 | 11 |
| B-3 | 9 | 80 | 11 |
| B-4 | 24 | 65 | 11 |
| B-5 | 1 | 88 | 11 |
| B-6 | 0 | 89 | 11 |

[Heat Treatment]

The sintered R1-T-B based magnet work of No. A-1 in Table 1 was cut and ground into a 7.4 mm×7.4 mm×7.4 mm cube. Next, in the sintered R1-T-B based magnet work of No. A-1, on a face (single face) that was perpendicular to the alignment direction, R2-Ga alloy (Nos. B-1 to B-6) was spread in an amount of 3.3 mass % each, with respect to 100 mass % of the sintered R1-T-B based magnet work. In spreading each of the R2-Ga alloys of Nos. B-1 to B-6 on the sintered R1-T-B based magnet work, the amount of RH spread on the sintered R1-T-B based magnet work (which varies depending on the composition of RH in the R2-Ga alloy) is indicated as "RH spread amount" in Table 3. Moreover, as a comparative example, $TbF_3$ was spread so as to result in spreading the RH in an amount of 0.20 mass % on a surface of the sintered R1-T-B based magnet work defining a face (single face) that was perpendicular to the alignment direction. Thereafter, a first heat treatment was performed at a temperature shown in Table 3 in argon which was controlled to a reduced pressure of 50 Pa, followed by a cooling down to room temperature, whereby a sintered R1-T-B based magnet work having undergone the first heat treatment was obtained. Furthermore, for this sintered R1-T-B based magnet work having undergone the first heat treatment, a second heat treatment was performed at a temperature shown in Table 3 in argon which was controlled to a reduced pressure of 50 Pa, thus producing sintered R-T-B based magnets (Nos. 1-1 to 1-7). Note that the aforementioned cooling (i.e., cooling down to room temperature after performing the first heat treatment) was conducted by introducing an argon gas in the furnace, so that an average cooling rate of 25° C./minute existed from the temperature at which the heat treatment was effected (i.e., 900° C.) to 300° C. At the average cooling rate (25° C./minute), variation in the cooling rate (i.e., a difference between the highest value and the lowest value of the cooling rate) was within 3° C./minute. For the resultant sintered R-T-B based magnets Nos. 1-1 to 1-7, in order to remove any thickened portion in the R2-Ga alloy, a surface grinder was used to cut 0.2 mm off the entire surface of each sample, whereby samples respectively in the form of a 7.0 mm×7.0 mm×7.0 mm cube were obtained. In one of the resultant sintered R-T-B based magnets, an RH (Tb) amount was measured by using Inductively Coupled Plasma Optical Emission Spectroscopy (ICP-OES). Then, the mass % value by which the RH (Tb) amount had increased from that of the sintered R1-T-B based magnet work (No. A-1) before the diffusion step (before the first heat treatment) was determined. The results are indicated at "amount of RH increase" in Table 3.

[Sample Evaluations]

With a B—H tracer, $B_r$ and $H_{cJ}$ in another of the resultant sintered R-T-B based magnets were measured. The results are shown in Table 3. The amount of $H_{cJ}$ improvement is indicated as $\Delta H_{cJ}$ in Table 3. $\Delta H_{cJ}$ in Table 3 is obtained by subtracting the value of $H_{cJ}$ (1385 kA/m) of each sintered R1-T-B based magnet work before diffusion (after tempering at 500° C.) from the $H_{cJ}$ values of Nos. 1-1 to 1-7.

TABLE 3

| No. | sintered R1-T-B based magnet work | R2-Ga alloy | first heat treatment | second heat treatment | RH spread amount (mass %) | amount of RH increase (mass %) | $B_r$ (T) | $H_{cJ}$ (kA/m) | $\Delta H_{cJ}$ (kA/m) | Notes |
|---|---|---|---|---|---|---|---|---|---|---|
| 1-1 | A-1 | B-1 | 900° C. | 500° C. | 0.10 | 0.05 | 1.38 | 1785 | 400 | Inv. |
| 1-2 | A-1 | B-2 | 900° C. | 500° C. | 0.20 | 0.10 | 1.38 | 1800 | 415 | Inv. |
| 1-3 | A-1 | B-3 | 900° C. | 500° C. | 0.30 | 0.15 | 1.38 | 1810 | 425 | Inv. |
| 1-4 | A-1 | B-4 | 900° C. | 500° C. | 0.80 | 0.40 | 1.37 | 1815 | 430 | Inv. |
| 1-5 | A-1 | B-5 | 900° C. | 500° C. | 0.02 | 0.01 | 1.38 | 1595 | 210 | Comp. |
| 1-6 | A-1 | B-6 | 900° C. | 500° C. | 0.00 | 0.00 | 1.37 | 1585 | 200 | Comp. |
| 1-7 | A-1 | $TbF_3$ | 900° C. | 500° C. | 0.20 | 0.02 | 1.37 | 1500 | 120 | Comp. |

As shown in Table 3, all examples of the present invention (Nos. 1-1 to 1-4), in which RH was diffused together with RL and Ga by allowing the R2-Ga alloy to diffuse, such that RH was increased through diffusion by not less than 0.05 mass % and not more than 0.40 mass %, had a $\Delta H_{cJ}$ so high as 400 kA/m or more, and high $B_r$ and high $H_{cJ}$ were obtained. On the other hand, the amount of $H_{cJ}$ improvement was about a half or less ($\Delta H_{cJ}$ of 120 to 210 kA/m) of those attained by the examples of the present invention, such that high $B_r$ and high $H_{cJ}$ were not obtained, in all of: No. 1-5, in which the amount of RH increase was smaller than the range according to the present disclosure; No. 1-6, in which the R2-Ga alloy did not contain any RH; and No. 1-7, which only received diffusion of RH (i.e., $TbF_3$ alone, without diffusion of RL and Ga). The amount of RH increase was 0.10 mass % in No. 1-2, which is an example of the present invention where RH was diffused together with RL and Ga from an R2-Ga alloy, whereas the amount of RH increase was 0.02 mass % in No. 1-7, which is a comparative example where only RH was diffused by the same RH spread amount (0.20 mass %) as in No. 1-2. Thus, in the case where RH is diffused together with RL and Ga, five times more RH is being introduced into the magnet interior as compared to the case where only RH is diffused. Thus, the present disclosure makes it possible to greatly reduce the amount of RH used, and attain high $\Delta H_{cJ}$ with a small amount of RH used. However, such a high $\Delta H_{cJ}$ will not be obtained if the amount of increase due to RH diffusion exceeds 0.40 mass %. As is indicated by Nos. 1-1 to 1-4 in Table 3, as RH increases from 0.05 mass % to 0.40 mass %, the amount of improvement $\Delta H_{cJ}$ gradually lowers. Specifically, $\Delta H_{cJ}$ is improved by 15 kA/m when the introduced amount of RH increases by 0.05 mass % from No. 1-1 (0.05 mass %) to No. 1-2 (0.10 mass %); however, from No. 1-2 (0.10 mass %) to No. 1-3 (0.15 mass %), $\Delta H_{cJ}$ is improved by 10 kA/m for a 0.05 mass % increase in the introduced amount of RH; and from No. 1-3 (0.15 mass %) to No. 1-4 (0.40 mass %), $\Delta H_{cJ}$ is improved by 5 kA/m for a 0.25 mass % increase in the introduced amount of RH. Thus, the amount of improvement $\Delta H_{cJ}$ becomes gradually small. Therefore, above 0.40 mass %, it is impossible to obtain high $B_r$ and high $H_{cJ}$ while reducing the amount of RH used, because the effect of $H_{cJ}$ improvement is low. Moreover, the present disclosure makes it possible to obtain high $\Delta H_{cJ}$ even as compared to a value obtained by totaling the respective $\Delta H_{cJ}$ values when separately conducting a diffusion from an alloy of RL and Ga and a diffusion of RH. While the example of the present invention No. 1-2 had a $\Delta H_{cJ}$ of 415 kA/m, a total $\Delta H_{cJ}$ between the $\Delta H_{cJ}$ (200 kA/m) when only an alloy of RL and Ga (sample No. 1-6) was allowed to diffuse and the $\Delta H_{cJ}$ (120 kA/m) of sample No. 1-7, in which the same spread amount of RH as in No. 1-2 (0.20 mass %) was spread, was 320 kA/m. Thus, it is in the example of the present invention No. 1-2 that $\Delta H_{cJ}$ is being greatly improved (320 kA/m→415 kA/m).

Example 2

Except for being adjusted so that the sintered R1-T-B based magnet work composition would approximately result in the composition of No. A-2 in Table 4, a plurality of sintered R1-T-B based magnet works were produced by a similar method to that of Example 1. Components of each resultant sintered R1-T-B based magnet work were measured similarly to Example 1. The component analysis is shown in Table 4. For reference sake, one of the resultant sintered R1-T-B based magnet works was subjected to usual tempering (480° C.), and its $B_r$ and $H_{cJ}$ were measured with a B—H tracer, which indicated $B_r$: 1.39 T, $H_{cJ}$: 1290 kA/m. By a similar method to that of Example 1, No. B-2 was provided as an R2-Ga alloy. Then, except for performing the heat treatments at the first heat treatment temperatures and second heat treatment temperatures shown in Table 5, sintered R-T-B based magnets were produced by a similar method to that of Example 1. With respect to each resultant sample, an amount of RH increase, $B_r$, $H_{cJ}$, and $\Delta H_{cJ}$ were determined by similar methods to those of Example 1. The results are shown in Table 5.

TABLE 4

| | composition of sintered R1-T-B based magnet work (mass %) | | | | | | | | | | | | |
|---|---|---|---|---|---|---|---|---|---|---|---|---|---|
| No. | Nd | Pr | Dy | Tb | B | Cu | Al | Ga | Zr | Nb | Co | Fe | eq. (1) |
| A-2 | 24.0 | 7.0 | 0.0 | 0.0 | 0.91 | 0.1 | 0.2 | 0.2 | 0.0 | 0.0 | 1.0 | 67.1 | ○ |

TABLE 5

| No. | sintered R1-T-B based magnet work | R2-Ga alloy | first heat treatment | second heat treatment | RH spread amount (mass %) | amount of RH increase (mass %) | $B_r$ (T) | $H_{CJ}$ (kA/m) | $\Delta H_{cJ}$ (kA/m) | Notes |
|---|---|---|---|---|---|---|---|---|---|---|
| 2-1 | A-2 | B-2 | 900° C. | 500° C. | 0.20 | 0.10 | 1.39 | 1730 | 440 | Inv. |
| 2-2 | A-2 | B-2 | 900° C. | 500° C. | 0.20 | 0.10 | 1.38 | 1820 | 530 | Inv. |
| 2-3 | A-2 | B-2 | 950° C. | 500° C. | 0.20 | 0.10 | 1.38 | 1760 | 470 | Inv. |
| 2-4 | A-2 | B-2 | 1050° C. | 500° C. | 0.20 | 0.10 | 1.36 | 1440 | 150 | Comp. |
| 2-5 | A-2 | B-2 | 500° C. | 450° C. | 0.20 | 0.10 | 1.39 | 1330 | 40 | Comp. |
| 2-6 | A-2 | B-2 | 900° C. | 400° C. | 0.20 | 0.10 | 1.40 | 1040 | −250 | Comp. |

As shown in Table 5, examples of the present invention (Nos. 2-1 to 2-3) in which the temperatures of the first heat treatment and the second heat treatment were within the ranges according to the present disclosure $\Delta H_{cJ}$ was so high as 400 kA/m or more, and high $B_r$ and high $H_{cJ}$ were obtained. On the other hand, $\Delta H_{cJ}$ was half or less of those of the examples of the present invention, such that high $B_r$ and high $H_{cJ}$ were not obtained, in all of: Nos. 2-4 and 2-5, in which the first heat treatment was outside the range according to the present disclosure; and No. 2-6, in which the second heat treatment temperature was outside the range according to the present disclosure.

Example 3

Except for being adjusted so that the sintered R1-T-B based magnet work composition would approximately result in the compositions of Nos. A-3 to A-18 in Table 6, sintered R1-T-B based magnet works were produced by a similar method to that of Example 1. Components of each resultant sintered R1-T-B based magnet work were measured similarly to Example 1. The component analysis is shown in Table 6.

TABLE 6

| | composition of sintered R1-T-B based magnet work (mass %) | | | | | | | | | | | | |
|---|---|---|---|---|---|---|---|---|---|---|---|---|---|
| No. | Nd | Pr | Dy | Tb | B | Cu | Al | Ga | Zr | Nb | Co | Fe | eq. (1) |
| A-3 | 24.0 | 7.0 | 0.0 | 0.0 | 1.00 | 0.1 | 0.2 | 0.4 | 0.1 | 0.0 | 1.0 | 66.2 | X |
| A-4 | 24.0 | 7.0 | 0.0 | 0.0 | 0.96 | 0.1 | 0.2 | 0.4 | 0.1 | 0.0 | 1.0 | 66.2 | X |
| A-5 | 24.0 | 7.0 | 0.0 | 0.0 | 0.90 | 0.1 | 0.2 | 0.4 | 0.1 | 0.0 | 1.0 | 67.3 | ○ |
| A-6 | 24.0 | 7.0 | 0.0 | 0.0 | 0.85 | 0.1 | 0.2 | 0.4 | 0.1 | 0.0 | 1.0 | 67.4 | ○ |
| A-7 | 24.0 | 7.0 | 0.0 | 0.0 | 0.80 | 0.1 | 0.2 | 0.4 | 0.1 | 0.0 | 1.0 | 67.4 | ○ |
| A-8 | 24.0 | 7.0 | 0.0 | 0.0 | 0.78 | 0.1 | 0.2 | 0.4 | 0.1 | 0.0 | 1.0 | 67.4 | ○ |
| A-9 | 22.0 | 5.0 | 0.0 | 0.0 | 0.87 | 0.1 | 0.2 | 0.3 | 0.0 | 0.2 | 1.0 | 71.3 | ○ |
| A-10 | 25.0 | 8.0 | 0.0 | 0.0 | 0.87 | 0.1 | 0.2 | 0.3 | 0.0 | 0.2 | 1.0 | 65.3 | ○ |
| A-11 | 28.0 | 8.0 | 0.0 | 0.0 | 0.87 | 0.1 | 0.2 | 0.3 | 0.0 | 0.2 | 1.0 | 62.3 | ○ |
| A-12 | 30.0 | 0.0 | 0.0 | 0.0 | 0.87 | 0.1 | 0.2 | 0.0 | 0.0 | 0.0 | 1.0 | 68.8 | ○ |
| A-13 | 17.0 | 13.0 | 0.0 | 0.0 | 0.87 | 0.1 | 0.2 | 0.0 | 0.0 | 0.0 | 1.0 | 68.8 | ○ |
| A-14 | 24.0 | 9.0 | 0.5 | 0.0 | 0.88 | 0.2 | 0.2 | 0.0 | 0.0 | 0.0 | 1.0 | 65.3 | ○ |
| A-15 | 24.0 | 9.0 | 0.5 | 0.0 | 0.88 | 0.2 | 0.2 | 0.5 | 0.0 | 0.0 | 1.0 | 64.8 | ○ |
| A-16 | 24.0 | 9.0 | 0.5 | 0.0 | 0.88 | 0.2 | 0.2 | 0.8 | 0.0 | 0.0 | 1.0 | 64.5 | ○ |
| A-17 | 24.0 | 9.0 | 0.5 | 0.0 | 0.88 | 0.2 | 0.2 | 1.2 | 0.0 | 0.0 | 1.0 | 64.1 | ○ |
| A-18 | 24.0 | 6.0 | 0.0 | 0.0 | 0.89 | 0.1 | 0.1 | 0.3 | 0.0 | 0.0 | 1.0 | 68.6 | ○ |

By a similar method to that of Example 1, No. B-3 and $TbF_3$ were provided as an R2-Ga alloy. Then, in Nos. 3-1 to 3-16 in Table 7, the R2-Ga alloy was spread on the sintered R1-B based magnet work similarly to Example 1. In 3-17, the R2-Ga alloy was spread similarly to Example 1, and furthermore, $TbF_3$ was spread so as to result in spreading the RH in an amount of 0.40 mass % on a surface of the sintered R1-T-B based magnet work defining a face (single face) that was perpendicular to the alignment direction. Then, except for performing the heat treatments at the first heat treatment temperatures and second heat treatment temperature shown in Table 7, sintered R-T-B based magnets were produced by a similar method to that of Example 1. With respect to each resultant sample, an amount of RH increase, $B_r$, and $H_{cJ}$ were determined by similar methods to those of Example 1. The results are shown in Table 7.

TABLE 7

| No. | sintered R1-T-B based magnet work | R2-Ga alloy | first heat treatment | second heat treatment | RH spread amount (mass %) | amount of RH increase (mass %) | $B_r$ (T) | $H_{cJ}$ (kA/m) | Notes |
|---|---|---|---|---|---|---|---|---|---|
| 3-1 | A-3 | B-3 | 900° C. | 500° C. | 0.30 | 0.15 | 1.40 | 1390 | Comp. |
| 3-2 | A-4 | B-3 | 900° C. | 500° C. | 0.30 | 0.15 | 1.40 | 1600 | Inv. |
| 3-3 | A-5 | B-3 | 900° C. | 500° C. | 0.30 | 0.15 | 1.37 | 1760 | Inv. |
| 3-4 | A-6 | B-3 | 900° C. | 500° C. | 0.30 | 0.15 | 1.36 | 1790 | Inv. |
| 3-5 | A-7 | B-3 | 900° C. | 500° C. | 0.30 | 0.15 | 1.34 | 1660 | Inv. |
| 3-6 | A-8 | B-3 | 900° C. | 500° C. | 0.30 | 0.15 | 1.33 | 1320 | Comp. |
| 3-7 | A-9 | B-3 | 950° C. | 500° C. | 0.30 | 0.15 | 1.25 | 790 | Comp. |
| 3-8 | A-10 | B-3 | 950° C. | 500° C. | 0.30 | 0.15 | 1.34 | 1740 | Inv. |

TABLE 7-continued

| No. | sintered R1-T-B based magnet work | R2-Ga alloy | first heat treatment | second heat treatment | RH spread amount (mass %) | amount of RH increase (mass %) | $B_r$ (T) | $H_{cJ}$ (kA/m) | Notes |
|---|---|---|---|---|---|---|---|---|---|
| 3-9 | A-11 | B-3 | 950° C. | 500° C. | 0.30 | 0.15 | 1.30 | 1190 | Comp. |
| 3-10 | A-12 | B-3 | 900° C. | 500° C. | 0.30 | 0.15 | 1.39 | 1730 | Inv. |
| 3-11 | A-13 | B-3 | 900° C. | 500° C. | 0.30 | 0.15 | 1.37 | 1855 | Inv. |
| 3-12 | A-14 | B-3 | 900° C. | 500° C. | 0.30 | 0.15 | 1.34 | 1710 | Inv. |
| 3-13 | A-15 | B-3 | 900° C. | 500° C. | 0.30 | 0.15 | 1.32 | 1895 | Inv. |
| 3-14 | A-16 | B-3 | 900° C. | 500° C. | 0.30 | 0.15 | 1.31 | 1780 | Inv. |
| 3-15 | A-17 | B-3 | 900° C. | 500° C. | 0.30 | 0.15 | 1.28 | 1575 | Comp. |
| 3-16 | A-18 | B-2 | 900° C. | 500° C. | 0.20 | 0.10 | 1.38 | 1795 | Inv. |
| 3-17 | A-18 | B-2 + $TbF_3$ | 900° C. | 500° C. | 0.60 | 0.30 | 1.38 | 1810 | Inv. |

As shown in Table 7, examples of the present invention (Nos. 3-2 to 3-5, No. 3-8, Nos. 3-10 to 3-14, Nos. 3-16 and 3-17), which were within the composition range for a sintered R1-T-B based magnet work according to the present disclosure, all had an $H_{cJ}$ of 1600 kA/m or more, and all of these examples of the present invention attained high $B_r$ and high $H_{cJ}$. Moreover, as indicated by No. 3-17, the present disclosure attained high $B_r$ and high $H_{cJ}$ also when spreading $TbF_3$ together with the R2-Ga alloy. Furthermore, as is clear from Nos. 3-2 to No. 3-5, i.e., examples of the present invention which shared substantially the same composition except for their B amounts, Nos. 3-3 to 3-5 satisfying (eq. 1) attained even higher $H_{cJ}$ than did No. 3-2, which failed to satisfy eq. (1). On the other hand, $H_{cJ}$ was less than 1600 kA/m, such that high $B_r$ and high $H_{cJ}$ were not obtained, in all of: Nos. 3-1 and No. 3-6, in which the B content in the sintered R1-T-B based magnet work was outside the range according to the present disclosure; Nos. 3-7 and 3-9, in which the R content was outside the range according to the present disclosure; and No. 3-15, in which the Ga content was outside the range according to the present disclosure.

Example 4

Except for being adjusted so that the sintered R1-T-B based magnet work composition would approximately result in the compositions of Nos. A-19 to A-21 in Table 8, sintered R1-T-B based magnet works were produced by a similar method to that of Example 1. Components of each resultant sintered R1-T-B based magnet work were measured similarly to Example 1. The component analysis is shown in Table 8. Moreover, except for being adjusted so that the R2-Ga alloy composition would approximately result in the compositions of Nos. B-7 to B-21 in Table 9, R2-Ga alloys were produced by a similar method to that of Example 1. Components of each resultant R2-Ga alloy were measured similarly to Example 1. The component analysis is shown in Table 9.

TABLE 8

| | composition of sintered R1-T-B based magnet work (mass %) | | | | | | | | | | | | |
|---|---|---|---|---|---|---|---|---|---|---|---|---|---|
| No. | Nd | Pr | Dy | Tb | B | Cu | Al | Ga | Zr | Nb | Co | Fe | eq. (1) |
| A-19 | 24.0 | 7.0 | 0.0 | 0.0 | 0.86 | 0.1 | 0.1 | 0.2 | 0.0 | 0.0 | 1.0 | 67.1 | ○ |
| A-20 | 31.0 | 0.0 | 0.0 | 0.0 | 0.88 | 0.1 | 0.1 | 0.2 | 0.0 | 0.0 | 1.0 | 67.1 | ○ |
| A-21 | 24.0 | 7.0 | 0.0 | 0.0 | 0.84 | 0.1 | 0.2 | 0.0 | 0.0 | 0.0 | 1.0 | 67.1 | ○ |

TABLE 9

| | composition of R2-Ga alloy(mass %) | | | | | |
|---|---|---|---|---|---|---|
| No. | Nd | Pr | Tb | Ga | Cu | Sn |
| B-7 | 0 | 54 | 6 | 40 | 0 | 0 |
| B-8 | 0 | 59 | 6 | 35 | 0 | 0 |
| B-9 | 0 | 74 | 6 | 20 | 0 | 0 |
| B-10 | 0 | 83 | 6 | 11 | 0 | 0 |
| B-11 | 0 | 91 | 6 | 3 | 0 | 0 |
| B-12 | 0 | 83 | 6 | 11 | 0 | 0 |
| B-13 | 9 | 74 | 6 | 11 | 0 | 0 |
| B-14 | 17 | 76 | 6 | 3 | 0 | 0 |
| B-15 | 10 | 59 | 6 | 15 | 0 | 0 |
| B-16 | 20 | 63 | 6 | 11 | 0 | 0 |
| B-17 | 83 | 0 | 6 | 11 | 0 | 0 |
| B-18 | 0 | 77 | 12 | 11 | 0 | 0 |
| B-19 | 0 | 77 | 12 | 10 | 1 | 0 |
| B-20 | 0 | 77 | 12 | 5 | 15 | 0 |
| B-21 | 0 | 77 | 12 | 10 | 0 | 1 |

Except for performing the heat treatments at the first heat treatment temperatures and second heat treatment temperature shown in Table 10, sintered R-T-B based magnets were produced by a similar method to that of Example 1. With respect to each resultant sample, an amount of RH increase, $B_r$, and $H_{cJ}$ were determined by similar methods to those of Example 1. The results are shown in Table 10.

TABLE 10

| No. | sintered R1-T-B based magnet work | R2-Ga alloy | first heat treatment | second heat treatment | RH spread amount (mass %) | amount of RH increase (mass %) | $B_r$ (T) | $H_{cJ}$ (kA/m) | Notes |
|---|---|---|---|---|---|---|---|---|---|
| 4-1 | A-19 | B-7 | 800° C. | 500° C. | 0.20 | 0.02 | 1.36 | 1620 | Inv. |
| 4-2 | A-19 | B-8 | 800° C. | 500° C. | 0.20 | 0.08 | 1.36 | 1650 | Inv. |
| 4-3 | A-19 | B-9 | 800° C. | 500° C. | 0.20 | 0.08 | 1.36 | 1710 | Inv. |
| 4-4 | A-19 | B-10 | 800° C. | 500° C. | 0.20 | 0.08 | 1.36 | 1750 | Inv. |
| 4-5 | A-19 | B-11 | 800° C. | 500° C. | 0.20 | 0.08 | 1.36 | 1640 | Inv. |
| 4-6 | A-20 | B-12 | 850° C. | 500° C. | 0.20 | 0.10 | 1.37 | 1750 | Inv. |
| 4-7 | A-20 | B-13 | 850° C. | 500° C. | 0.20 | 0.10 | 1.37 | 1740 | Inv. |
| 4-8 | A-20 | B-14 | 850° C. | 500° C. | 0.20 | 0.10 | 1.37 | 1680 | Inv. |
| 4-9 | A-20 | B-15 | 850° C. | 500° C. | 0.20 | 0.10 | 1.37 | 1710 | Inv. |
| 4-10 | A-20 | B-16 | 850° C. | 500° C. | 0.20 | 0.10 | 1.37 | 1730 | Inv. |
| 4-11 | A-20 | B-17 | 850° C. | 500° C. | 0.20 | 0.10 | 1.37 | 1620 | Inv. |
| 4-12 | A-21 | B-18 | 900° C. | 500° C. | 0.40 | 0.20 | 1.34 | 1760 | Inv. |
| 4-13 | A-21 | B-19 | 900° C. | 500° C. | 0.40 | 0.20 | 1.34 | 1780 | Inv. |
| 4-14 | A-21 | B-20 | 900° C. | 500° C. | 0.40 | 0.20 | 1.34 | 1740 | Inv. |
| 4-15 | A-21 | B-21 | 900° C. | 500° C. | 0.40 | 0.20 | 1.34 | 1770 | Inv. |

As shown in Table 10, examples of the present invention (Nos. 4-1 to 4-15) all had an $H_{cJ}$ of 1600 kA/m or more, and all of these examples of the present invention attained high $B_r$ and high $H_{cJ}$. As compared to No. 4-1 in which the R2-Ga alloy composition fell outside preferred embodiments according to the present disclosure (i.e., the R2 accounted for less than 65 mass % in the entire R2-Ga alloy; and Ga accounted for more than 35 mass %) and No. 4-11 (in which the R2-Ga alloy did not contain any Pr), the other examples of the present invention (Nos. 4-2 to 4-10 and 4-12 to 4-15) attained higher $H_{cJ}$. Thus, in the R2-Ga alloy, preferably, R2 accounts for not less than 65 mass % and not more than 97 mass % of the entire R2-Ga alloy; Ga accounts for not less than 3 mass % and not more than 35 mass % of the entire R2-Ga alloy; and R2 always contains Pr.

INDUSTRIAL APPLICABILITY

According to the present disclosure, a sintered R-T-B based magnet with high remanence and high coercivity can be produced. A sintered magnet according to the present disclosure is suitable for various motors such as motors to be mounted in hybrid vehicles, home appliance products, etc., that are exposed to high temperatures.

REFERENCE SIGNS LIST

12 . . . main phase of $R_2T_{14}B$ compound; 14 . . . grain boundary phase; 14*a* . . . intergranular grain boundary phase; 14*b* . . . grain boundary triple junction

The invention claimed is:

1. A method for producing a sintered R-T-B based magnet, comprising:

a step of providing a sintered R1-T-B based magnet work that contains:

R1: not less than 27.5 mass % and not more than 35.0 mass % (where R1 is at least one rare-earth element which always includes at least one of Nd and Pr), B: not less than 0.80 mass % and not more than 0.99 mass %, Ga: not less than 0 mass % and not more than 0.8 mass %, M: not less than 0 mass % and not more than 2.0 mass % (where M is at least one of Cu, Al, Nb and Zr), and T: 60 mass % or more (where T is Fe, or Fe and Co, the Fe content accounting for 85 mass % or more in the entire T);

a step of providing an R2-Ga alloy (where R2 is at least two light rare-earth elements which always include at least one of Tb and Dy and at least one of Pr and Nd; and 50 mass % or less of Ga can be replaced by at least one of Cu and Sn);

a diffusion step of, while keeping at least a portion of the R2-Ga alloy in contact with at least a portion of a surface of the sintered R1-T-B based magnet work, performing a first heat treatment at a temperature which is not lower than 700° C. and not higher than 950° C. in a vacuum or an inert gas ambient, to increase a content of the at least one of Tb and Dy in the sintered R1-T-B based magnet work by not less than 0.05 mass % and not more than 0.40 mass %; and a step of subjecting the sintered R1-T-B based magnet work having undergone the first heat treatment to a second heat treatment at a temperature which is not lower than 450° C. and not higher than 750° C. but which is lower than the temperature of the first heat treatment, in a vacuum or an inert gas ambient, wherein the sintered R1-T-B based magnet work satisfies equation (1) below:

$$[T]/55.85>14\times[B]/10.8 \quad (1)$$

(where [T] is the T content by mass %; and [B] is the B content by mass %).

2. The method for producing a sintered R-T-B based magnet of claim 1, wherein the R2 always contains the Pr, and the Pr content accounts for 50 mass % or more of the entire R2.

3. The method for producing a sintered R-T-B based magnet of claim 1, wherein the R2 in the R2-Ga alloy comprises the Pr and the at least one of Tb and Dy.

4. The method for producing a sintered R-T-B based magnet of claim 1, wherein, in the R2-Ga alloy, the R2 accounts for not less than 65 mass % and not more than 97 mass % of the entire R2-Ga alloy, and the Ga accounts for not less than 3 mass % and not more than 35 mass % of the entire R2-Ga alloy.

* * * * *